United States Patent [19]

Taylor

[11] Patent Number: 4,670,104

[45] Date of Patent: Jun. 2, 1987

[54] POLAR SOLVENT DEDUSTING

[75] Inventor: James L. Taylor, Naperville, Ill.

[73] Assignees: Standard Oil Company (Indiana); Gulf Oil Corporation (Pennsylvania), both of Chicago, Ill.

[21] Appl. No.: 750,746

[22] Filed: Jun. 28, 1985

Related U.S. Application Data

[63] Continuation-in-part of Ser. No. 541,154, Oct. 12, 1983, Pat. No. 4,544,477.

[51] Int. Cl.[4] ..... C10G 1/00; C10G 21/00

[52] U.S. Cl. ..... 202/84; 208/177; 208/251 R; 208/424; 202/99

[58] Field of Search ..... 196/14.52, 46.1; 210/729, 770, 804; 202/206, 226, 84, 108, 109, 99; 208/8 R, 8 LE, 11 R, 11 LE, 251 R, 177

[56] References Cited

U.S. PATENT DOCUMENTS

| | | | |
|---|---|---|---|
| 4,040,958 | 8/1977 | Rammler | 208/177 |
| 4,162,965 | 7/1979 | Clapper | 208/177 |
| 4,164,466 | 8/1979 | Balwin et al. | 208/177 |
| 4,225,420 | 9/1980 | Rhodes | 208/177 |
| 4,242,102 | 12/1980 | Snell | 208/8 LE X |
| 4,246,093 | 1/1981 | Wolcott, Jr. | 208/11 R X |
| 4,401,551 | 8/1983 | Mitchell | 208/11 LE |
| 4,544,477 | 11/1985 | Taylor | 208/11 R |

*Primary Examiner*—Andrew H. Metz
*Assistant Examiner*—Glenn A. Caldarola
*Attorney, Agent, or Firm*—Thomas W. Tolpin; William T. McClain; William H. Magidson

[57] ABSTRACT

A process and system is provided to produce and dedust oil from oil shale and other types of solid hydrocarbon-containing material. In the process, raw oil shale is retorted, preferably with solid heat carrier material, to liberate an effluent product stream of hydrocarbons containing entrained particulates of dust derived from the oil shale or other solid hydrocarbon-containing material. A fraction of oil containing most of the dust is separated from the effluent product stream and fed to one or more dedusters. The dust-laden oil is dissolved in a special mixture of dedusting solvents which contains both polar and non-polar dedusting solvents. In the deduster, the dissolved oil is separated into a dedusted stream of oil and solvents and a residual stream of dust-laden sludge. Solvents are recovered from the dedusted stream as well as the sludge. The recovered solvents are recycled to the deduster for use in dedusting the oil. The sludge is preferably dried and combusted for use as part of the solid heat carrier material in the retort.

8 Claims, 19 Drawing Figures

LIGHT GASES
STEAM
LIGHT SHALE OIL
MIDDLE SHALE OIL
DUST LADEN HEAVY SHALE OIL
SPENT SHALE
RAW OIL SHALE
RETORT
LIFT PIPE
DEDUSTED OIL WITH SOLVENTS
UPSTREAM DEDUSTER
DOWNSTREAM DEDUSTER
SOLVENT FREE OIL
SOLVENT RECOVERY
RECYCLE SOLVENT
POLAR SOLVENT
NON-POLAR SOLVENT
SLUDGE
SLUDGE SOLVENT RECOVERY

POLAR SOLVENT DEDUSTING

CROSS-REFERENCES TO RELATED APPLICATIONS

This application is a continuation-in-part of application Ser. No. 541,154, filed Oct. 12, 1983 now U.S. Pat.No. 4,544,477, entitled "Polar Solvent Extraction and Dedusting Process" which has been allowed.

BACKGROUND OF THE INVENTION

This invention relates to synthetic fuels and, more particularly, to producing and dedusting shale oil.

Researchers have renewed their efforts to find alternate sources of energy and hydrocarbons in view of past rapid increases in the price of crude oil and natural gas. Much research has been focused on recovering hydrocarbons from solid hydrocarbon-containing material such as oil shale, coal, and tar sands by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce duce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be efficiently converted to oil by extraction. Upon heating oil shale to a sufficient temperature, the kerogen is thermally decomposed to liberate vapors, mist, and liquid droplets of shale oil and light hydrocarbon gases such as methane, ethane, ethene, propane, and propene, as well as other products such as hydrogen, nitrogen, carbon dioxide, carbon monoxide, ammonia, steam, and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Syncrude is the upgraded product of shale oil.

The process of pyrolyzing the kerogen in oil shale, known as retorting, to form liberated hydrocarbons, can be done in surface retorts in aboveground vessels or in in situ retorts underground. In principle, the retorting of shale and other hydrocarbon-containing materials, such as coal and tar sands, comprises heating the solid hydrocarbon-containing material to an elevated temperature and recovering the vapors and liberated effluent. However, as medium grade oil shale yields approximately 20 to 25 gallons of oil per ton of shale, the expense of materials handling is critical to the economic feasibility of a commercial operation.

In surface retorting, oil shale is mined from the ground, brought to the surface, crushed and placed in vessels where it can be contacted with a hot solid heat carrier material, such as hot spent shale, ceramic balls, metal balls, or sand or a gaseous heat carrier material, such as light hydrocarbon gases, for heat transfer. The resulting high temperatures cause shale oil to be liberated from the oil shale leaving a retorted, inorganic material and carbonaceous material such as coke. The carbonaceous material can be burned by contact with oxygen at oxidation temperatures to recover heat and to form a spent oil shale relatively free of carbon. Spent oil shale which has been depleted in carbonaceous material can be removed from the retort and recycled as heat carrier material or discarded. The combustion gases are dedusted in cyclones, electrostatic precipitators, or other gas-solid separation systems.

During fluid bed, moving bed, and other types of surface retorting, decrepitation of oil shale occurs when particles of oil shale collide with each other or impinge against the walls of the retort forming substantial quantities of minute entrained particulates of shale dust. The use of hot spent shale as heat carrier material can aggravate the dust problem. Rapid retorting is desirable to minimize thermal cracking of valuable condensable hydrocarbons. Shale dust is also emitted and carried away with the effluent product stream during modified in situ retorting as a flame front passes through a fixed bed of rubblized shale, as well as in fixed bed surface retorting, but dust emission is not as aggravated as in other types of surface retorting.

Shale dust ranges in size from less than 1 micron to 1000 microns and is entrained and carried away with the effluent product stream. Because shale dust is so small, it cannot be effectively removed to commercially acceptable levels by conventional dedusting equipment.

The retorting, carbonization, or gasification of coal, peat, and lignite and the retorting or extraction of tar sands, gilsonite, and oil-containing diatomaceous earth create similar dust problems.

After retorting, the effluent product stream of liberated hydrocarbons and entrained dust is withdrawn from the retort through overhead lines and subsequently conveyed to a separator, such as a single or multiple-stage distillation column, quench tower, scrubbing cooler, or condenser, where it can be separated into fractions of light gases, light oils, middle oils, and heavy oils with the bottom heavy oil fraction containing essentially all of the dust. As much as 65% by weight of the bottom heavy oil fraction may consist of dust.

It is very desirable to upgrade the bottom heavy oil into more marketable products, such as light oils and middle oils, but because the heavy oil fraction is laden with dust, it is very viscous and cannot be pipelined. Dust-laden heavy oil plugs up hydrotreaters and catalytic crackers, abrades valves, heat exchangers, outlet orifices, pumps, and distillation towers, builds up insulative layers on heat-exchange surfaces reducing their efficiency, and fouls up other equipment. Furthermore, the dusty heavy oil erodes turbine blades and creates emission problems. Moreover, the dusty heavy oil cannot be refined with conventional equipment.

In an effort to solve this dust problem, electrostatic precipitators have been used as well as cyclones located both inside and outside the retort. Electrostatic precipitators and cyclones, however, must be operated at high temperatures and the product stream must be maintained at approximately the temperature attained during the retorting process to prevent any condensation and accumulation of dust on processing equipment. Maintaining the effluent stream at high temperatures allows detrimental side reactions, such as cracking, coking, and polymerization of the effluent product stream, which tend to decrease the yield and quality of condensable hydrocarbons.

Over the years, various processes and equipment have been suggested to decrease the dust concentration in the heavy oil fraction and/or upgrade the heavy oil into more marketable light oils and medium oils. Such prior art dedusting processes and equipment have included the use of cyclones, electrostatic precipitators, pebble beds, scrubbers, filters, electric treaters, spiral tubes, ebullated bed catalytic hydrotreaters, desalters, autoclave settling zones, sedimentation, gravity settling, percolation, hydrocloning, magnetic separation, electrical precipitation, stripping, and binding, as well as the use of diluents, solvents, and chemical additives before centrifuging. Typifying those prior art processes and equipment and related processes and equipment are those found in U.S. Pat. Nos. 1,668,898; 1,687,763; 1,703,192; 1,707,759; 1,788,515; 2,235,639; 2,524,859; 2,717,865; 2,719,114; 2,723,951; 2,793,104; 2,871,181; 2,879,224; 2,899,736; 2,904,499; 2,911,349; 2,952,620; 2,968,603; 2,982,701; 3,001,774; 3,008,894; 3,034,979; 3,058,903; 3,252,886; 3,255,104; 3,468,789; 3,519,552; 3,560,369; 3,684,699; 3,703,442; 3,784,462; 3,791,956; 3,799,855; 3,808,120; 3,900,389; 3,901,791; 3,910,834; 3,929,625; 3,951,771; 3,974,073; 3,990,885; 4,028,222; 4,040,958; 4,049,540; 4,057,490; 4,069,133; 4,075,080; 4,080,285; 4,082,043; 4,088,567; 4,094,770; 4,105,536; 4,132,030; 4,151,067; 4,151,073; 4,158,622; 4,159,949; 4,162,965; 4,166,441; 4,182,672; 4,199,432; 4,220,522; 4,225,420; 4,226,699; 4,242,102; 4,244,812; 4,246,093; 4,293,401; 4,312,747; 4,324,651; 4,350,582; 4,354,856; 4,388,179; 4,404,086; 4,415,430; 4,415,434; 4,415,442; 4,420,389; and 4,473,461 as well as in the articles by Rammler, R. W., "The Retorting of Coal, Oil Shale and Tar Sand By Means of Circulated Fine-Grained Heat Carriers as a Preliminary Stage in the Production of Synthetic Crude Oil", Volume 65, Number 4, *Quarterly of the Colorado School of Mines,* pages 141–167 (October 1970) and Schmalfeld, I. P., "The Use of The Lurgi/-Ruhrgas Process For The Distillation of Oil Shale", Volume 70, Number 3, *Quarterly of the Colorado School of Mines,* pages 129–145 (July 1975). These prior art processes and equipment have not been successful to economically decrease the dust concentration in the heavy oil fraction to acceptable levels.

It is therefore desirable to provide an improved process for producing and dedusting synthetic oil.

SUMMARY OF THE INVENTION

An improved process and system is provided to produce and dedust synthetic oil from oil shale, tar sands, and tar sands bitumen. Advantageously, the dedusted oil can safely be pipelined through valves, outlet orifices, pumps, heat exchangers, and distillation columns and can be refined in hydrotreaters and catalytic crackers.

The oil can be produced underground in modified or true in situ retorts, or can be produced above ground in surface retorts or in solvent extraction vessels. In the preferred form, the oil is produced in a surface retort by mixing raw oil shale or other solid hydrocarbon-containing material in the retort with solid heat carrier material at a sufficient retorting temperature to liberate an effluent product stream of hydrocarbons containing entrained particulates of dust. The surface retort can be a static mixer retort, gravity flow retort, fluid bed retort, screw conveyor retort, or rotating pyrolysis drum retort.

In the preferred form, the effluent product stream of hydrocarbons is partially dedusted in a cyclone or some other gas-solids separation device before being fed to at least one fractionator, quench tower, scrubber, or condenser where it is separated into one or more fractions of normally liquid oil. For reasons of economy and dedusting efficiency, it is preferred to settle most of the dust in the bottom fraction of heavy oil. In the preferred process, the heavy oil fraction contains from 25% to 65% by weight dust and most preferably at least 45% by weight dust.

In this invention, the dust-laden oil is efficiently, economically, and effectively dedusted by dissolving the dust-laden oil in a mixture of dedusting solvents containing both polar and non-polar dedusting solvents each having a molecular weight less than 130 grams per mole. The dissolved oil is separated into a substantially dedusted phase and a dust-enriched residual phase. The dust-enriched phase settles to the bottom as sludge. Dedusting can occur in one or more solvent dedusters, such as mixer settlers, leachers, dedusting vessels, extraction columns, or towers. Desalters should not be used as dedusters with the process herein described since they do not effectively dedust shale oil with the designated polar and non-polar solvents, and because they typically operate with water which is not an effective polar dedusting solvent for applicant's described process.

In the preferred process, the dedusting solvents and dusty oil are fed in countercurrent flow relationship to each other into a series of dedusters. Dissolving of the oil in the dedusting solvents can be enhanced by mixing the dusty oil and solvents by direct mechanical agitation or by pressure-driven static mixers, such as an orifice plate mixer with optional gravitational flow stationary internals. The polar and non-polar solvents are preferably combined or mixed along with recycled solvents before being injected into the deduster for reasons of efficiency, but can be separately injected into the deduster, if desired.

Desirably, the polar dedusting solvent has an affinity to produce substantial separation of the dissolved dust-laden oil as well as rapid settling of the dust. The polar solvents are preferably alcohols containing 1 to 4 carbon atoms and most preferably methanol, for best results. Use of water as a polar dedusting solvent is ineffective and should be avoided.

Desirably, the non-polar dedusting solvent is capable of reducing the total amount of solvent necessary to dissolve the influent dust-laden oil. Non-polar dedusting solvents are desirably alkanes containing 3 to 9 carbon atoms or light shale oil, preferably a naptha cut thereof. The preferred non-polar solvents are alkanes having 5 to 7 carbon atoms such as pentane, hexane, heptane, and combinations of these alkanes.

In the preferred process, the residual stream of dust-laden sludge and the retorted shale or other hydrocarbon-containing material is combusted in a combustor, such as a vertical lift pipe combustor, for use as the solid heat carrier material in the retort. Desirably, the residual stream of dust-laden sludge is heated and dried in a dryer, such as a fluid bed dryer, porcupine dryer, or disc dryer, before recovering the dedusting solvents in the sludge for use in dedusting the dusty oil. The dried sludge can be combusted and recycled to the dryer for use as heat carrier material in heating and drying the influent dust-laden sludge.

Dedusting solvents in the dedusted stream are also recovered for use in dedusting the dusty oil. Solvent recovery can be accomplished in one or more steps involving cooling, settling, and/or heating, such as by flashing or evaporation. Centrifuges and filters are not generally effective for recovering polar and non-polar solvents in applicant's process and should therefore be avoided. Costs and heat duty required for solvent recovery can be substantially reduced by cooling the dedusted stream prior to settling and evaporation.

As used in this application, the term "dust" means particulates derived from solid hydrocarbon-containing material. The particulates range in size from less than 1 micron to 1000 microns and include retorted and raw unretorted hydrocarbon-containing material, as well as spent hydrocarbon-containing material or sand if the latter are used as solid heat carrier material during retorting. Dust derived from retorting of oil shale consists primarily of clays, calcium, magnesium oxides, carbonates, silicates, and silicas. Dust derived from the retorting or extraction of tar sands consists primarily of silicates, silicas, and carbonates. Dust derived from the retorting, carbonization, or gasification of coal consists primarily of char and ash.

The terms "retorted" hydrocarbon-containing material and "retorted" shale as used in this application refer to hydrocarbon-containing material and oil shale, respectively, which have been retorted to liberate hydrocarbons leaving an inorganic material containing carbon residue.

The terms "spent" hydrocarbon-containing material and "spent" oil shale as used herein mean retorted hydrocarbon-containing material and oil shale, respectively, from which most of the carbon residue has been removed by combustion.

The term "synthetic oil" as used herein means oil which has been produced from solid hydrocarbon-containing material. The synthetic oil in the present process is dedusted according to the principles of the present invention before being upgraded, such as in a hydrotreater, hydrocracker, or catalytic cracker.

The terms "dust-laden" or "dusty" synthetic oil as used herein mean synthetic oil which contains a substantial amount of entrained particulates of dust.

The term "polar" solvent as used herein means a solvent that tends to interact with other compounds or itself through acid-base interactions, hydrogen bonding, dipole-dipole interactions, or by dipole-induced dipole interactions. Polar solvents used in the subject dedusting process are moderately or strongly polar and are capable of hydrogen bonding.

The term "non-polar" solvent as used herein means a solvent that is not a polar solvent. Non-polar solvents interact with other compounds or themselves predominantly through dispersion forces. Non-polar solvents interact with polar solvents mainly through dipole-induced dipole interactions or through dispersion forces. Non-polar dedusting solvents in the subject dedusting process can also include weakly polar solvents.

The terms "normally liquid," "normally gaseous," "condensible," "condensed," or "noncondensible" are relative to the condition of the subject material at a temperature of 77° F. (25° C.) at atmospheric pressure.

A more detailed explanation of the invention is provided in the following description and appended claims taken in conjunction with the accompanying drawings.

DETAILED DESCRIPTION OF THE PREFERRED EMBODIMENTS

Figure 1:
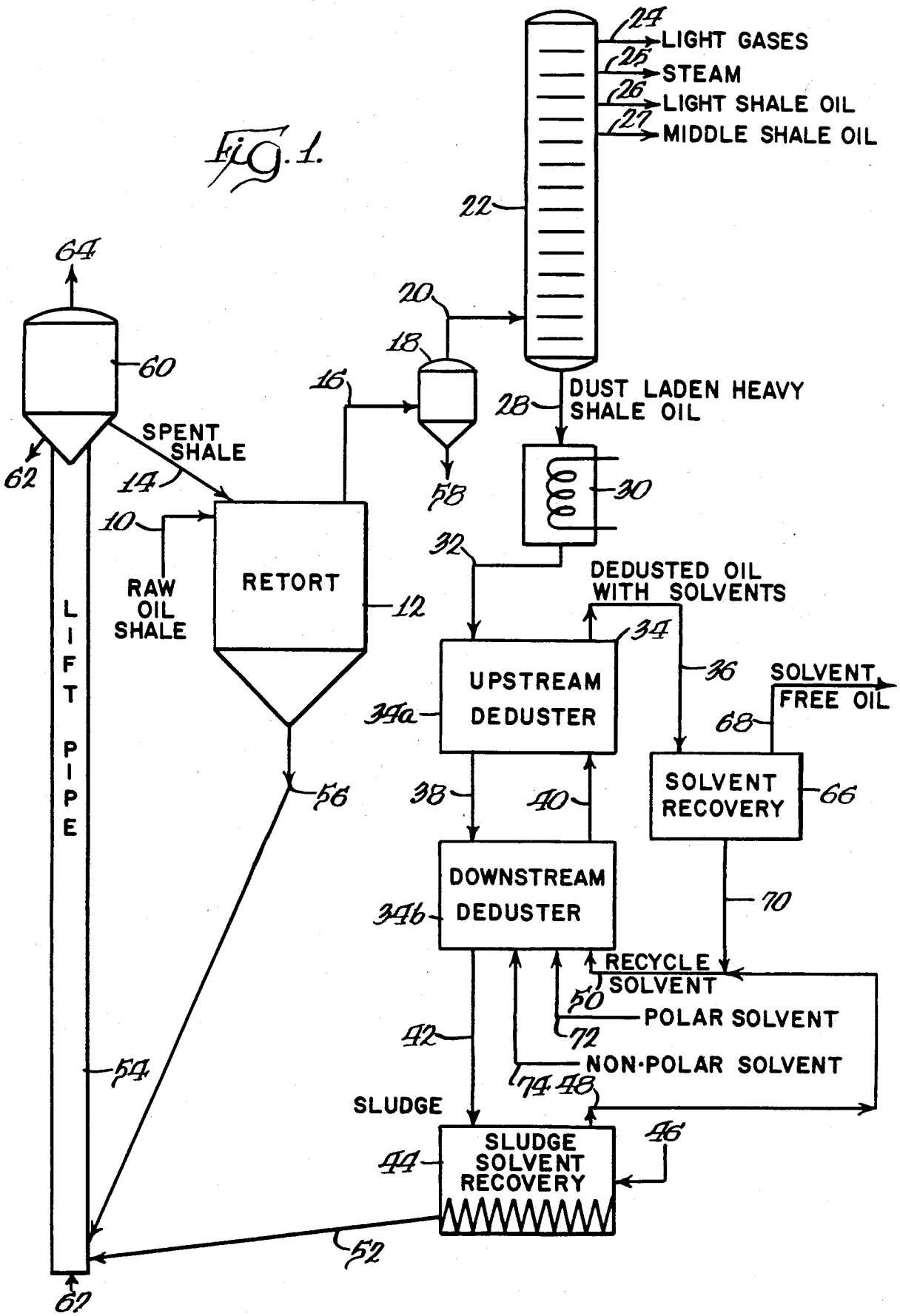
FIG. 1 is a schematic flow diagram of a process and system for producing and dedusting synthetic oil in accordance with principles of the present invention.

Referring now to FIG. 1, a polar solvent extraction and dedusting process and system is provided to produce and dedust synthetic oil from solid hydrocarbon-containing material, such as oil shale, tar sands, and oil-containing diatomaceous earth (diatomite). While the present invention is described hereinafter with particular reference to the processing of oil shale, it will be apparent that the process and system can also be used in connection with the processing of other hydrocarbon-containing materials, such as tar sands and oil-containing diatomaceous earth.

In the process and system, raw, fresh oil shale, which preferably contains an oil yield of at least 15 gallons per ton of shale particles, is crushed and sized to a maximum fluidizable size of 10 mm and fed through raw shale inlet line 10 at a temperature from ambient temperature to 600° F. into an aboveground surface retort 12. The retort can be a gravity flow retort, a static mixer retort with internals and a downstream surge bin, a fluid bed retort, a rotating pyrolysis drum retort with an accumulator having a rotating trommel screen, or a screw conveyor retort with a surge bin. The fresh oil shale can be crushed by conventional crushing equipment, such as an impact crusher, jaw crusher, gyratory crusher, or roll crusher, and screened with conventional screening equipment, such as a shaker screen or a vibrating screen.

Spent (combusted) oil shale and spent (combusted) dried sludge, which together provide solid heat carrier material, are fed through heat carrier line 14 at a temperature from 1000° F. to 1400° F., preferably from 1200° F. to 1300° F., into retort 12 to mix with heat and retort the raw oil shale in retort 12. The retorting temperature of the retort is from 850° F. to 1000° F., preferably from 900° F. to 960° F., near atmospheric pressure. Air and molecular oxygen are prevented from entering the retort in order to prevent combustion of oil shale, shale oil, and liberated gases in the retort.

In a fluid (fluidized) bed retort, inert fluidizing lift gas, such as light hydrocarbon gases, is injected into the bottom of the retort through a gas injector to fluidize, entrain, and enhance mixing of the raw oil shale and solid heat carrier material in the retort. Other types of retorts, such as a fixed bed retort, a rock pump retort, or a rotating grate retort, can be used with a gaseous heat carrier material in lieu of solid heat carrier material.

During retorting, hydrocarbons and steam are liberated from the raw oil shale as a gas, vapor, mist, or liquid droplets and most likely a mixture thereof along with entrained particulates of oil shale (dust) ranging in size from less than 1 micron to 1000 microns. The effluent product stream of hydrocarbons and steam liberated during retorting are withdrawn from the upper portion of the retort through an overhead product line 16 and passed to one or more internal or external gas-solid separating devices, such as a cyclone 18 or a filter. The gas-solid separating device partially dedusts the effluent product stream. The partially dedusted stream exits the cyclone through transport line 20 where it is transported to one or more separators 22, such as quench towers, scrubbers, or fractionators, also referred to as fractionating columns or distillation columns.

In the separator 22, the effluent product stream is separated into fractions of light hydrocarbon gases, light shale oil, middle shale oil, and heavy shale oil. These fractions are discharged from the separator through lines 24–28, respectively. Heavy shale oil has a boiling point over 600° F. to 800° F. Middle shale oil has a boiling point over 400° F. to 500° F. and light shale oil has a boiling point over 100° F.

The solids bottom heavy shale oil fraction in the bottom separator line 28 is a slurry of dust-laden heavy shale oil that contains from 15% to 45% by weight of the effluent product stream. The dust-laden heavy oil, which is also referred to as "dusty oil," consists essentially of normally liquid heavy shale oil and from 1% to 65% by weight entrained particulates of oil shale dust, preferably at least 25% by weight oil shale dust, and most preferably at least 45% by weight oil shale dust for reasons of dedusting efficiency and economy. Oil shale dust is mainly minute particles of spent oil shale and lesser amounts of retorted and/or raw oil shale particulates. The temperature in the separator can be varied from 500° F. to 800° F., preferably about 600° F., at atmospheric pressure and controlled to assure that essentially all of the oil shale dust gravitates to and is entrained in the solids bottom heavy oil fraction. The dust-laden heavy oil has an API gravity from 5° to 20° and a mean average boiling point from 600° F. to 950° F.

The dusty heavy shale oil in the bottom separator line 28 is fed to a heat exchanger or cooler 30 where it is cooled to a temperature above its pour point, preferably to a temperature ranging from 50° F. to 300° F., and most preferably above 100° F. for best results. The cooled dusty oil exits the heat exchanger through cooling line 32 and is pumped or otherwise fed into one or more solvent dedusters 34, such as mixer settlers, leachers, dedusting vessels, extraction columns, or towers. The deduster can have two or more external or internal stages. In the preferred embodiment, there are two settlers (dedusters **34*a* and 34*b*) which are connected countercurrently in series with each other for best results. The dedusters 34*a* and 34*b* of FIG. 1** are arranged so that the influent dust-laden heavy shale oil is in countercurrent flow relationship to the influent dedusting solvents.

In the embodiment of FIG. 1, the influent dusty heavy oil is fed downwardly into the upper portion of the top upstream deduster **34*a* through inlet line 32. The dusty heavy oil flows to the upstream settler 34*a* where it is interacted and mixed with an upwardly moving stream of dedusting solvents and dedusted oil. A substantial portion of the influent dusty oil stream is dedusted, separated, and withdrawn through overhead dedusted stream line 36. The residual dust-laden portion of the influent dusty stream settles to the bottom of the top settler 34*a* and is discharged through residue line 38 into the upper portion of the bottom downstream settler (deduster) 34*b***.

The dust-laden residual stream moves downwardly by gravity flow through the downstream deduster **34*b* in countercurrent flow relationship to the upwardly moving stream of dedusting solvents. The upwardly moving stream of dedusting solvents interacts and mixes with the downwardly moving residual stream to dedust, separate, and remove a substantial portion of the remaining oil in the residual stream. The dedusted oil and solvents flow upwardly through the downstream settler 34*b* and are fed upwardly into the bottom portion of the upstream settler 34*a* through upflow line 40. The remaining residual dust-laden stream of sludge settles to the bottom of the downstream settler 34*b***.

The dust-laden sludge is discharged from the bottom of the downstream settler through a sludge line 42 where it is fed to a sludge solvent recovery device, such as an evaporator or dryer 44. Dryer 44 is desirably a porcupine screw conveyor dryer or fluid bed dryer, and most preferably a disc dryer for best results. In the dryer, the sludge is dried by heating to a temperature ranging from 150° F. to 950° F., and preferably to about 200° F. for reasons of thermal economy, until the sludge is separated into a dust-enriched residual stream of dried sludge and a recovered stream of solvents with a low dust content.

One of the primary functions of the dryer 44 is to evaporate and recover most of the solvents from the sludge. The recovered solvents are withdrawn through overhead recovered solvent line 48 and fed into the bottom portion of the downstream settler 34*b* through recycle solvent line 50. The dried sludge contains agglomerates of oil shale dust about 1 mm in diameter and is discharged through the bottom of the dryer through dried sludge line 52. The solids residence time in the dryer is from 0.5 minute to 120 minutes and preferably from 10 minutes to 30 minutes for best results. If desired, solid heat carrier material, such as combusted (spent) recycled dried sludge and combusted (spent) oil shale, can be fed to the dryer for use in heating the influent sludge. Furthermore, while it is preferred to dry the sludge to evaporate and recover residual solvents in the sludge for process efficiency, in some circumstances it may be desirable to combust the sludge without previously drying the sludge.

The dried sludge and heat carrier material from the dryer are conveyed through dried sludge line 52 to the bottom portion of an external, dilute phase, vertical lift pipe combustor 54. The lift pipe is spaced away and positioned remote from the retort. Retorted and spent oil shale particles from the retort 12 are discharged through the bottom of the retort and are fed by gravity flow or other conveying means through combustor feed line 56 to the bottom portion of the lift pipe. Shale dust removed from the product stream in cyclone 18 can also be conveyed by gravity flow or other conveying means through dust outlet line 58 to the bottom portion of the combustor lift pipe.

In the lift pipe combustor 54, the dried sludge, retorted shale, dust, and heat carrier material are fluidized, entrained, propelled, and conveyed upwardly into an overhead collection and separation bin 60 by air injected into the bottom portion of the lift pipe through air injection nozzle 62. Shale oil, solvents, and any carbon residue in the dried sludge are substantially completely combusted in the lift pipe along with residual carbon on the retorted shale and shale dust. The combustion temperature in the lift pipe overhead vessel is from 1000° F. to 1400° F. The combusted spent dried sludge, combusted oil shale, and combusted spent shale dust are discharged through an outlet in the bottom of the overhead bin into heat carrier feed lines 14 and 46 for use as solid heat carrier material in the retort 12 and dryer 44, respectively. Excess spent shale and sludge are withdrawn from the overhead bin and retort system through discharge line 62. In some circumstances, it may be desirable to feed the sludge directly into the retort or to combust the sludge in another combustor, other than the lift pipe, to recover heat from the residual oil in the sludge.

The carbon contained in the retorted oil shale and sludge is burned off mainly as carbon dioxide during combustion in the lift pipe and overhead bin. The carbon dioxide with the air and other products of combustion form combustion off-gases or flue gases which are withdrawn from the upper portion of the overhead bin through a combustion gas line 64. The combustion gases are dedusted in an external cyclone or an electrostatic precipitator before being discharged into the atmosphere or processed further to recover steam.

While an external dilute phase lift pipe combustor is preferred for best results, in some circumstances it may be desirable to use other types of combustors, such as a horizontal combustor, a fluid bed combustor, or an internal dilute phase lift pipe which extends vertically through a portion of the retort. If ceramic and/or metal balls are used as the solid heat carrier material, such as for rotating pyrolysis drum retorts, the retorting system should also have a ball separator, such as a rotating trommel screen, and a ball heater in lieu of or in combination with the combustor.

The residual oil and solvents in the sludge provide auxiliary fuel for the lift pipe combustor. Light hydrocarbon gases or shale oil can also be fed to the lift pipe to augment the fuel.

In order to enhance oil recovery and reduce the quantity of fresh solvents required, the extract (the dedusted stream of oil and solvents) is withdrawn from the upstream settler 34*a* through dedusted line 36 and fed into an extract solvent recovery system 66, such as any of the solvent recovery systems shown in FIGS. 17–21. In the solvent recovery system, which is explained in detail hereinafter, the dedusted stream is separated into a substantially solvent-free oil stream and a recovered solvent stream. The solvent-free oil stream is withdrawn from the solvent recovery system through overhead solvent-free oil line 68 and fed to a hydrotreater, catalytic cracker, or other downstream upgrading equipment. The recovered stream of solvents is discharged from the solvent recovery system through solvent discharge line 70 and is fed into recycled solvent line 50 for injection into the bottom portion of the downstream settler 34*b*. The recovered solvents from the dryer and the solvent recovery system are preferably combined and mixed together in a common unitary recycled solvent line 50 before being injected upwardly into the bottom portion of the downstream settler 34*b*.

Fresh makeup, polar dedusting solvent is injected upwardly into the bottom portion of the downstream settler 34*b* through polar solvent feed line 72. Fresh makeup, non-polar dedusting solvent is injected upwardly into the bottom portion of the downstream settler 34*b* through non-polar solvent feed line 74. The polar and non-polar solvents are preferably fed simultaneously into the deduster along with the recycled recovered solvents from the dryer and solvent recovery system to enhance dedusting effectiveness and efficiency while minimizing dedusting residence time.

Figure 2:
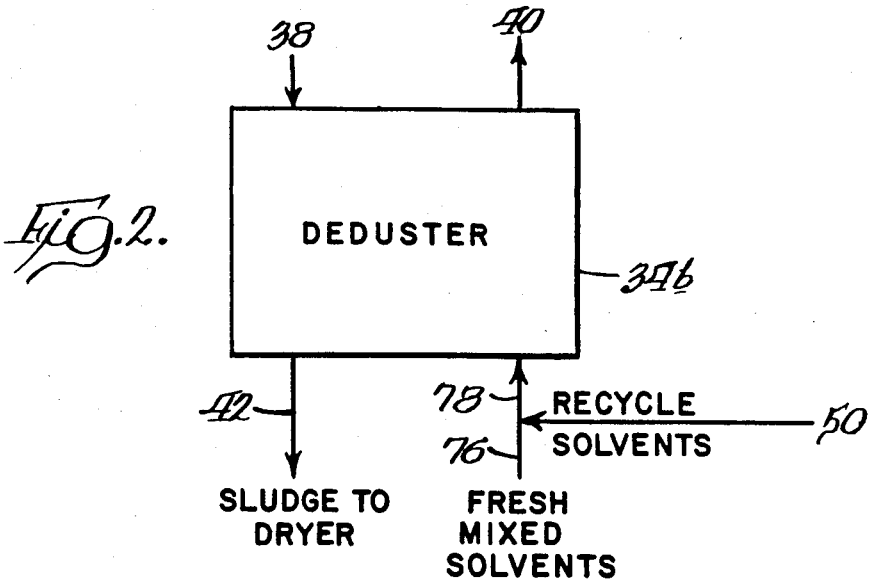
FIG. 2 is a schematic flow diagram of an alternate method of feeding solvents to a deduster.

As shown in FIG. 2, fresh makeup polar and non-polar solvents can be combined, mixed, and/or blended in a single unitary common fresh solvent line 76. Recovered (recycled) solvents from the dryers and solvent recovery system are combined, mixed, and/or blended in recycled solvent line 50. The recovered solvents in line 50 and the fresh makeup solvents in line 76 are combined, mixed, and/or blended in a combined, common, unitary single solvent feed line 78. Solvent feed line 78 feeds fresh polar and non-polar solvents along with recycled recovered solvents into the deduster.

The feed ratio of non-polar solvent to polar solvent being fed and injected into the deduster in the fresh makeup solvent feed lines and the recycled recovered solvent feed lines is from 1:10 to 3:1 and preferably from 1:5 to 2:1 for best results. The feed ratio of dust-laden heavy oil to the total amount of polar, non-polar, and recycled solvents being fed into the deduster is from 1:7 to 2:1 and preferably from 1:3 to 1:1 for best results.

Altering one of the variables at a time produces different results. Increasing the concentration of the dusty shale oil feed decreases the fraction of oil recovered because a greater fraction is insoluble. The solubility of the oil increases with the feed concentration. Increasing the oil feed-to-solvent ratio increases the quantity of soluble components which causes more shale oil to dissolve. The oil feed concentration has little effect on the initial settling rate. Settling is generally retarded by a greater concentration of fines (oil shale dust). The amount of oil precipitated increases with the concentration of oil feed which enlarges the floc size of the fines and enhances settling. The settling rate decreases with greater dust loading. Increasing the dedusting or feed temperature increases recovery with little decrease in the settling rate. A 20° C. increase in temperature can enhance oil recovery and dedusting from 65% to 85%. A 15% by weight increase in hexane or other non-polar solvents can achieve the same increase of oil recovery and dedusting as a 20° C. increase in feed or dedusting temperatures. Increasing the temperature also increases the solubility of the oil by an average of 1.5 weight percent per 10° C. If higher temperatures are used during dedusting, a lower solvent-to-feed ratio can be used with little penalty in settling rate. Since the solubility of the heavy shale oil in an alcohol/alkane mixture increases with temperature, the deduster should be operated at temperatures near the boiling point of the mixture to minimize solvent use.

The operating pressure of each deduster, when methanol is used as the polar solvent, is from atmospheric pressure to 500 psia and preferably 200 psia for economy of process equipment. The operating temperature of each deduster is from 100° F. to 500° F. and preferably below 250° F. for best results. A dedusting temperature below 100° F., which is below the oil pour point, can create problems. The operating temperature of the dedusters is dependent on the particular polar and non-polar solvents that are selected.

The solids residence time in the dedusters is from 10 minutes to 120 minutes and preferably from 30 minutes to 60 minutes for best results. The liquid residence time of the shale oil and solvents in the dedusters is from 5 minutes to 60 minutes and preferably from 10 minutes to 30 minutes for best results.

In the dedusters, the dust-laden heavy oil is dissolved in the polar and non-polar solvents. The dedusters separate the dissolved dusty oil into a substantially dedusted phase or stream and a dust-enriched phase or stream of dust-laden sludge. The sludge settles through the bottom of the downstream deduster at a rate of 10 feet per hour to 1200 feet per hour and preferably at least 75 feet per hour.

Three, four, or five dedusters can be operatively connected in series with each other to further enhance dedusting of the dusty oil. Five or more dedusters can be used effectively if low solvent-to-dusty oil feed ratios are desired.

From 80% to 99% and preferably at least 90% by weight of the influent heavy shale oil is dedusted in and recovered from the solvent dedusters. The solvent dedusting process also helps separate and remove arsenic, iron, and vanadium. The arsenic-to-carbon ratio is reduced about 80% relative to the dusty oil feed. The iron and vanadium contents are reduced by more than thirtyfold.

The dedusted product stream of oil and solvents in the dedusted stream line 36 (FIG. 1) contains 15% to 30% by weight heavy shale oil, 70% to 84% by weight polar and non-polar solvents, and a maximum of 1%, preferably less than 0.3%, and most preferably less than 0.1%, by weight oil shale dust.

The dust-laden residual stream of sludge which exits the deduster through sludge line 42 contains from 30% to 75%, and preferably at least 40%, by weight oil shale dust; from 1.5% to 13%, and preferably less than 8%, by weight heavy shale oil; and from 12% to 68.5%, and preferably less than 50%, by weight polar and non-polar solvents.

Polar dedusting solvents used in this dedusting process are characterized by their affinity and ability to produce substantial separation of the dissolved oil and rapid settling of the dust. The non-polar dedusting solvents used in this dedusting process are characterized by their affinity and ability to reduce the total amount of solvent necessary to dissolve the dust-laden heavy shale oil. For best results, the polar and non-polar solvents used for dedusting shale oil each have a molecular weight less than 130 grams per mole. The polar and non-polar solvents used for dedusting tar sands oil (bitumen) should have a molecular weight less than 125 grams per mole for best results.

Polar dedusting solvents useful for this process and system are alcohols containing 1 to 4 carbon atoms. In order to attain the best results, methanol is the most preferred polar dedusting solvent for dedusting heavy shale oil from atmospheric pressure to 200 psia.

Polar dedusting solvents that hydrogen bond weakly, especially alcohols, are useful in the dedusting solvent for producing rapid dust settling rates. Alkanes and aromatic hydrocarbons are desirable for use as non-polar solvents in the dedusting solvent on the basis of cost, density, and chemical stability. Dedusting solvents containing alkane and alcohol without aromatic hydrocarbons produce the highest oil recoveries and the greatest dedusting.

Polar solvents can be classified into three groups: (1) strongly hydrogen-bonding, (2) strongly dipolar, and (3) weakly hydrogen-bonding. Strongly hydrogen-bonding solvents, such as glycols and water, tend to self-associate strongly and are not very effective for dedusting shale oil. Because fines (oil shale dust) tend to partition between liquid interfaces, tenacious emulsions form when these immiscible solvents are mixed vigorously. Strongly dipolar compounds, such as ketones and esters, associate in much smaller aggregates. The association is very weak compared to hydrogen bonding because most non-electrolytes screen the dipolar charge separation. Strongly dipolar solvents are quite miscible with non-polar compounds. Solvents that hydrogen bond weakly, such as methanol, desirably form aggregates of intermediate size. As organic polymers, these aggregates have highly variable miscibility with other compounds, depending on the molecular weight or size of the aggregate. The aggregate size depends strongly on temperature and the concentration of the alcohol and solution. Solvents that hydrogen bond weakly are alcohols of low molecular weight, formamides, ethanol, amines, and cellusolves. Alcohols are preferred on the basis of cost. The strength of hydrogen bonding is quite sensitive to temperature. Solvents that hydrogen bond strongly at ambient temperature can also be useful dedusting solvents at elevated temperatures.

The non-polar dedusting solvent can be alkanes containing 3 to 9 carbon atoms (preferably a maximum of 7 carbon atoms to dedust shale oil). Normal alkane non-polar solvents, such as propane, butane, pentane, hexane, and heptane, as well as isomers and combinations of these alkanes, are preferred for enhanced dedusting effectiveness. Alkane non-polar solvents having from 5 to 7 carbon atoms, such as shale oil, light naphtha, pentane, hexane, heptane, and mixtures thereof, are preferably used as the non-polar solvent when dedusting at operating pressures from atmospheric pressure to 200 psia for best results.

Increasing the concentration of non-polar dedusting solvents increases the recovery and the dedusting of shale oil, but reduces the settling rate of the dust-laden sludge (fines). Increasing the concentration of methanol or other polar dedusting solvents greatly increases the settling rates of the fines but decreases the oil solubility.

Neat alkanes, compared to alkane/aromatic mixtures, are better non-polar solvents for use in the dedusting solvent. Neat alkanes give faster dust settling rates than alkane/aromatic mixtures. Higher temperatures are preferred for dedusting with alcohol/alkane mixtures because oil solubility increases with temperature, requiring the use of less dedusting solvent.

Figure 14:
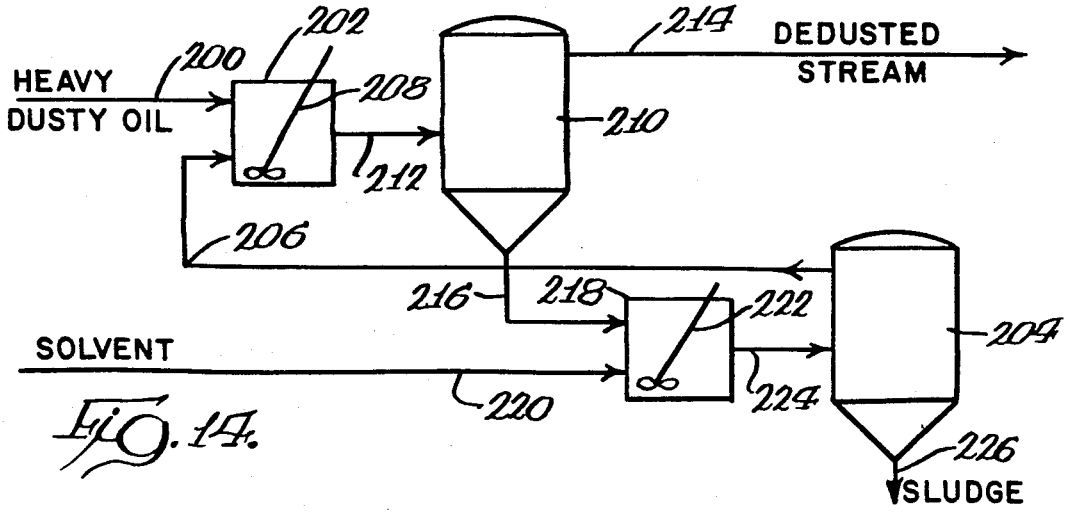
FIG. 14 (same page as FIG. 18) is a schematic flow diagram of two-stage countercurrent dedusters.
Figure 11:
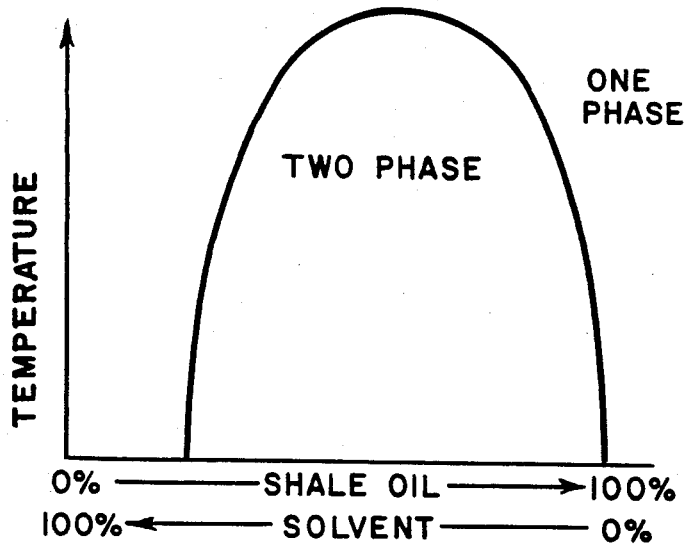
FIG. 11 is a chart showing the phase behavior as a function of temperature for oil and a polar solvent.
Figure 12:
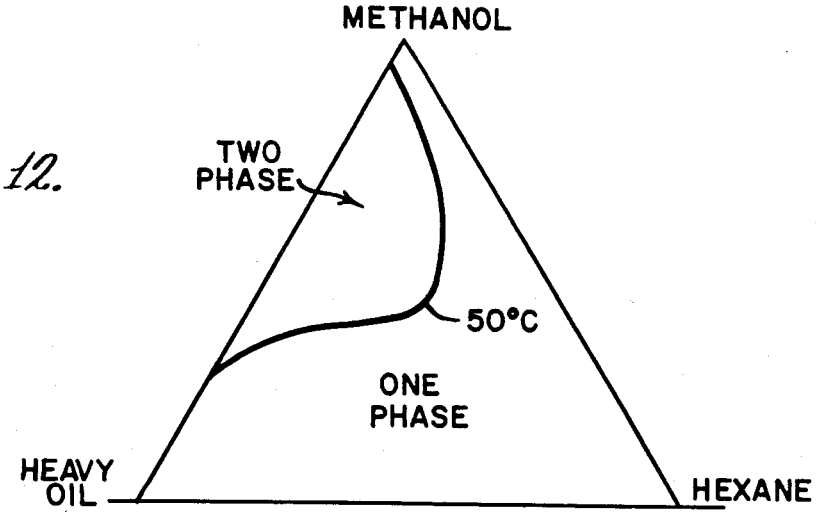
FIG. 12 is a phase diagram at a temperature of 50° C.
Figure 13:
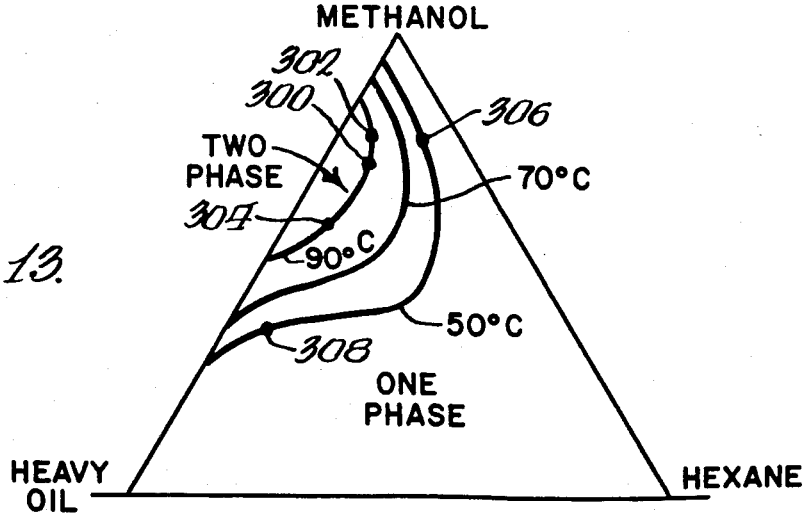
FIG. 13 are phase diagrams at different temperatures.

In order to quickly, efficiently, and effectively dedust the dusty heavy shale oil, the proportion and feed ratio of polar and non-polar solvents to the dusty heavy shale oil should be adjusted along with the dedusting temperature of the deduster to accommodate partial miscibility of the oil in the solvents to produce a dust-enriched sludge. The chart of FIG. 13 illustrates the relationship between the weight percentage of heavy shale oil and non-polar solvent to the dedusting temperature. The phase diagram of FIG. 14 shows the proportional relationship of heavy shale oil, methanol (polar solvent), and hexane (non-polar solvent) at a temperature of 50° C.

Figure 15:
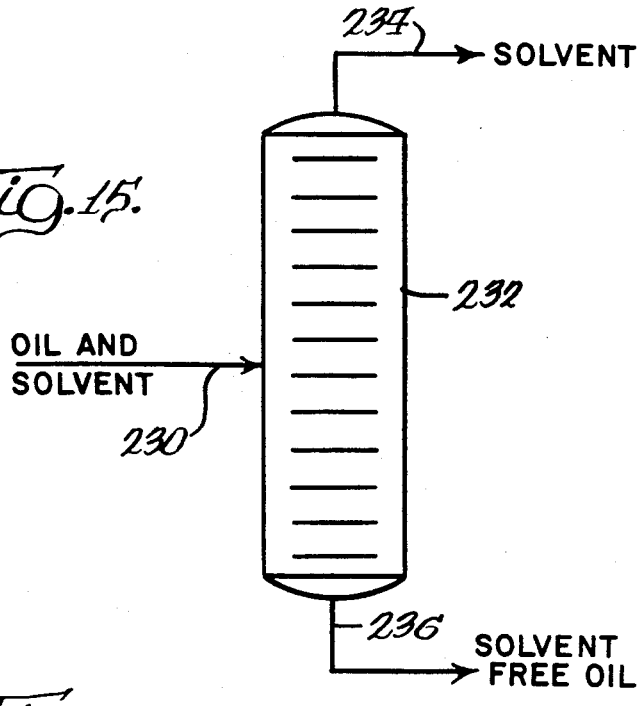
FIG. 15 is a schematic flow diagram of a distillation column for recovering solvents from the dedusted stream.

FIG. 15 is a phase diagram of a ternary system of shale oil, hexane (non-polar solvent), and methanol (polar solvent). The solid lines in the phase diagram are boundaries between the one and two-phase regions at the indicated temperatures of 20° C., 50° C., and 70° C. The phase diagram of FIG. 15 shows the relative proportion, feed ratio, and relationship of heavy shale oil, methanol, and hexane to attain two-phase separation at 50° C., 70° C., and 90° C. In the region enclosed by the boundary and the oil-methanol axis, mixtures of the components form two phases: (1) the first phase containing predominantly solvent, and (2) the second phase containing predominantly shale oil. Extensions of the tie lines pass through or near the oil apex. Outside this boundary, the three components are substantially miscible. Oil shale dust (fines) are not shown in the phase diagram because the dust is an insoluble, non-interacting phase.

Figure 3:
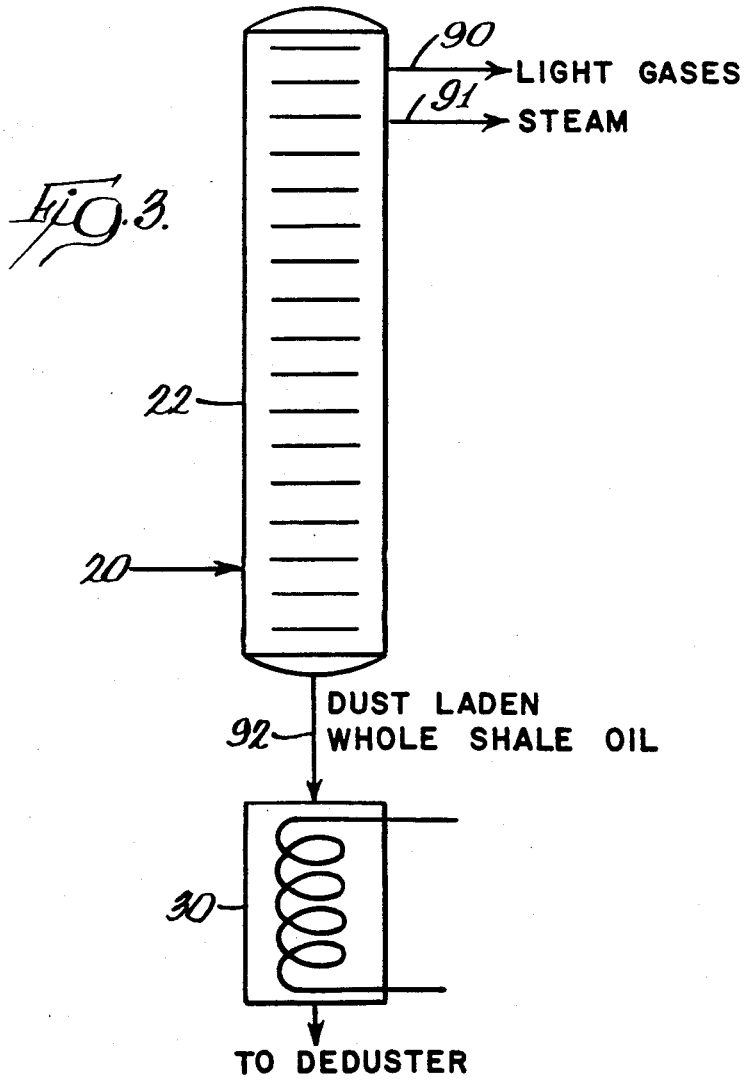
FIG. 3 is an alternative flow diagram for processing whole oil.

While it is preferred to dedust heavy shale oil containing at least 25% and preferably at least 40% by weight oil shale dust for enhanced solvency efficiency and dedusting effectiveness, in some circumstances it may be desirable to dedust whole shale oil instead of heavy shale oil. This may be accomplished by separating the effluent product stream of hydrocarbons and steam in the separator 22 (FIG. 3) into fractions of light hydrocarbon gases, steam, and dust-laden whole shale oil and removing these fractions through discharge lines 90, 91, and 92, respectively. The dust-laden whole oil fraction consists of normally liquid whole shale oil containing 0.1% to 25%, and preferably from 10% to 15%, by weight entrained particulates of oil shale dust. Whole shale oil comprises heavy shale oil, middle shale oil, and light shale oil. The dedusting, drying, and solvent recovery steps are the same as described with respect to FIG. 1, except that whole shale oil is processed in lieu of heavy shale oil. Because whole shale oil exits the fractionator at a much lower temperature than heavy shale oil, the dusty whole shale oil does not necessarily have to be cooled in a heat exchanger 30 before being injected into the deduster.

Figure 4:
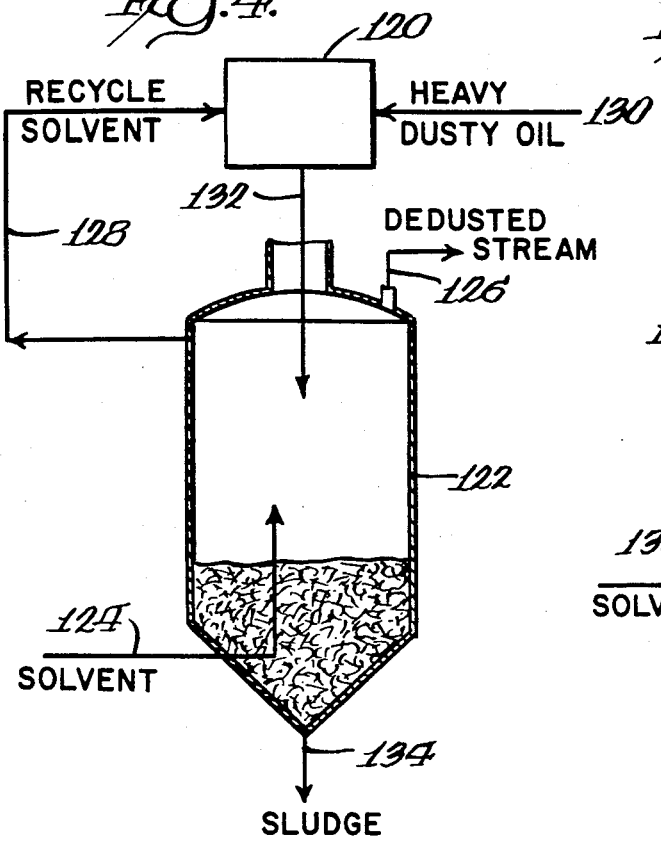
FIG. 4 is a schematic flow diagram of a static mixer and deduster.

The deduster of FIG. 4 has an upstream pressure-driven static mixer 120 and a downstream deduster 122. The upstream static mixer can be an orifice plate mixer with optional stationary internals. The stationary internals can be alternate tiers or arrays (levels) of longitudinally and laterally positioned baffles, deflectors, or elements in the form of elongated angle irons or inclined plates. The internals deflect and change the lateral direction of flow of the dusty heavy oil and dedusting solvents to enhance dissolving and mixing the oil in the dedusting solvents.

In the embodiment of FIG. 4, the polar, non-polar, and recovered recycled dedusting solvents are injected and fed upwardly into the downstream deduster 122 through solvent feed line 124. The dedusted stream of oil and solvents is withdrawn from the downstream deduster through overhead dedusted stream line 126. Solvents from the downstream deduster are withdrawn from the deduster and recycled to the static mixer 120 through recycle solvent line 128. Dust-laden heavy shale oil is fed into the static mixer through oil feed line 130. The internals in the static mixer mix and dissolve the dusty oil in the dedusting solvents. The mixture of oil and solvents is discharged from the static mixer into the downstream deduster through discharge line 132. The residual stream of dust-laden sludge is withdrawn from the bottom of the downstream deduster through sludge line 134. The other aspects of the process and system of FIG. 4 are similar to FIG. 1.

Figure 5:
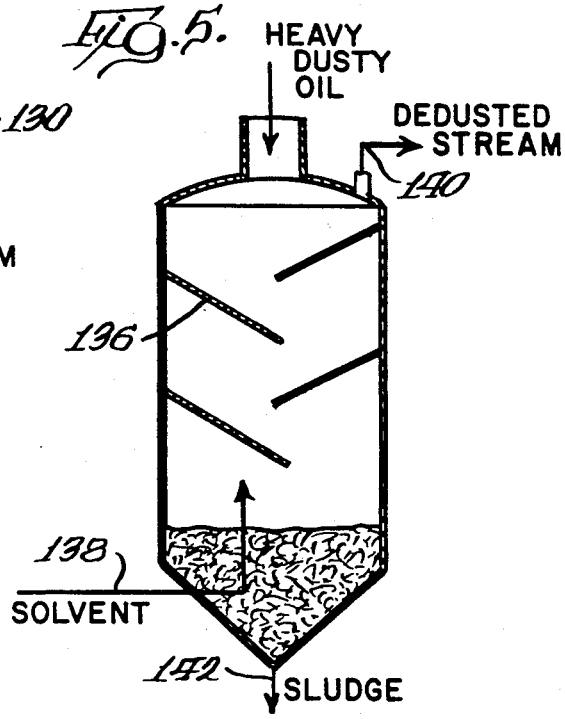
FIG. 5 is a schematic flow diagram of a deduster with downcombers or inclined internals.

In the deduster of FIG. 5, the stationary internals are in the form of zig-zag baffles or downcombers 136. The baffles extend alternately and laterally inwardly at a downward angle of inclination from the vertical peripheral wall of the deduster to a position slightly less than and spaced away from the vertical axis of the deduster. Desirably, the baffles are inclined downwardly at an angle ranging 15° to 75°, and preferably at about 45°, for enhanced mixing of the dusty oil and dedusting solvents. The baffles extending from the left-hand side of the deduster are parallel and symmetrically offset from the baffles extending from the righthand side of the deduster and vice versa. The illustrated arrangement of baffles provides a generally zig-zag flow pattern for gravitatingly mixing and dissolving the dust-laden heavy shale oil in the solvents. The baffles can extend to, past, or near the vertical centerline (axis) of the deduster. The baffles can be perforated to enhance mixing and dissolution of the oil. Polar, non-polar, and recycled recovered solvents are fed and injected upwardly in the deduster through solvent feed line 138. The dedusted stream of oil and solvents is withdrawn from the deduster through overhead dedusted stream line 140. The residual stream of dust-laden sludge is removed from the bottom of the deduster through sludge line 142. The other aspects of the process and system of FIG. 5 are similar to FIG. 1.

Figure 6:
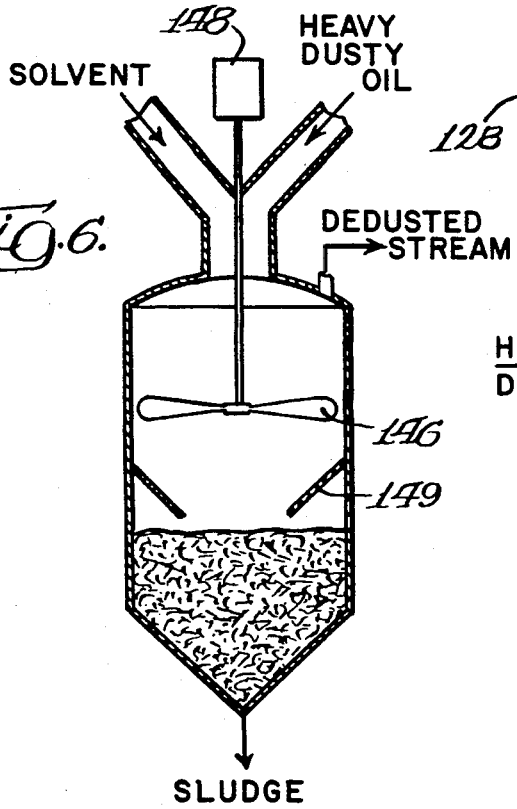
FIG. 6 is a schematic flow diagram of a deduster with a motor-driven mechanical agitator.

The deduster of FIG. 6 is similar to the deduster of FIG. 1, except that the deduster of FIG. 6 has a mechanical agitator, propeller, or mixing blades 146 driven by a motor 148 to mix and dissolve the dust-laden heavy shale oil in the solvents. Downwardly inclined stationary baffles 149 are positioned at a level below the blades 146 to substantially prevent the sludge from being remixed and re-entrained with the influent solvents.

Figure 7:
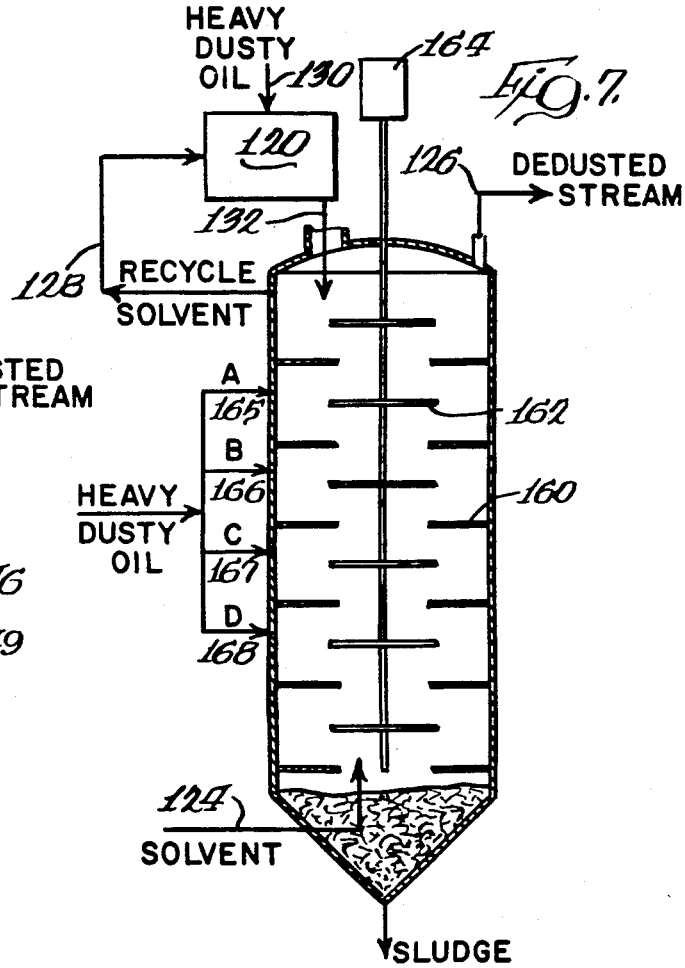
FIG. 7 is a schematic flow diagram of a static mixer and a deduster with a motor-driven rotating disc column and stationary donut-type internals.

The deduster of FIG. 7 has tiers of stationary annular donut plates 160 that are welded or otherwise fixedly secured to the peripheral wall of the deduster and has a rotating disc column 162 of vertically spaced, horizontal blades or discs which are driven by a motor 164 to further enhance mixing and dissolving of the dusty oil in the dedusting solvents. Some of the dusty oil can be fed into the deduster through one or more inlets 165–168 along the upright wall of the deduster. Other aspects of the process and system of FIG. 7 are similar to FIG. 1.

In the preferred embodiment, the solvents are mixed (combined) with the dusty shale oil before entering the deduster.

Figure 8:
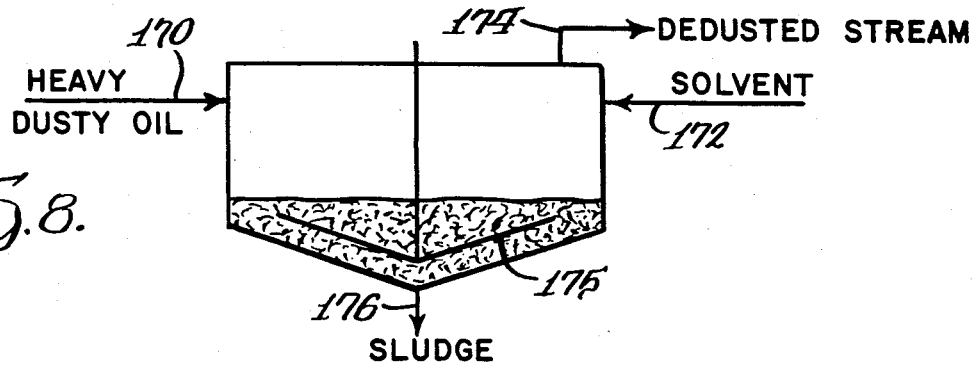
FIG. 8 is a schematic diagram of a deduster with another type of flow arrangement.

In the deduster of FIG. 8, the dusty shale oil is injected generally horizontally into the left-hand side of the deduster through oil line 170. Polar, non-polar, and recycled recovered dedusting solvents are injected generally horizontally into the right-hand side of the deduster through solvent feed line 172 in countercurrent flow relationship to the dusty oil. The dedusted stream of oil and solvents is withdrawn from the deduster through dedusted stream line 174. The residual stream of dust-laden sludge settles to the bottom of the deduster, where it is slowly stirred by a motor-driven rake 175, and is withdrawn from the deduster through sludge line 176. The other aspects of the process and system of FIG. 8 are similar to FIG. 1.

Figure 9:
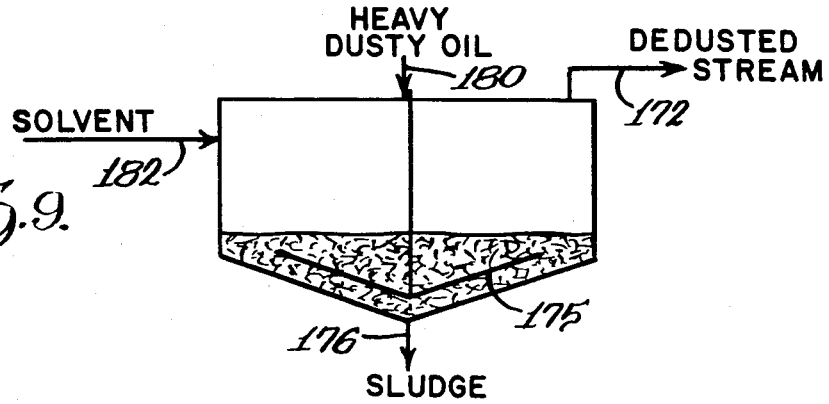
FIG. 9 is a schematic diagram of a deduster with a further type of flow arrangement.

The deduster of FIG. 9 is similar to the deduster of FIG. 8, except that the dust-laden shale oil is fed downwardly into the top of the deduster through oil line 180 and the polar, non-polar, and recycled recovered solvents are injected generally horizontally into the side of the deduster through solvent feed line 182 in perpendicular flow relationship to the dusty oil.

Figure 10:
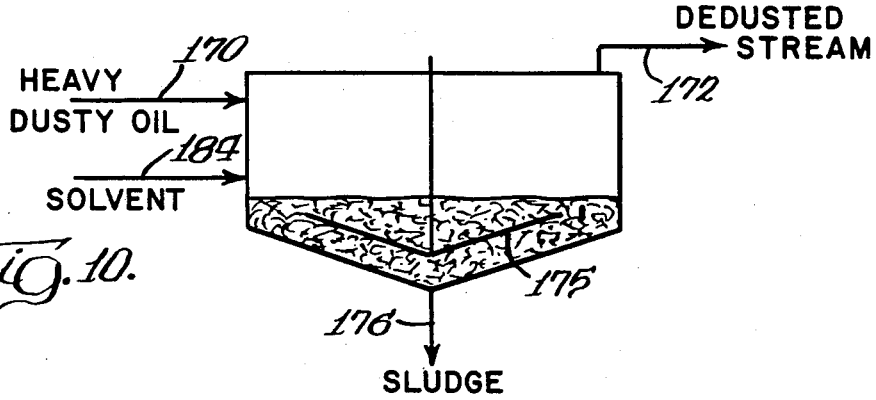
FIG. 10 is a schematic diagram of a deduster with still another type of flow arrangement.

The deduster of FIG. 10 is similar to the deduster of FIG. 8, except that the oil feed line 170 and the solvent feed line 184 are on the same side of the deduster so that the dust-laden shale oil and the dedusting solvents are injected into the deduster on the same side of the deduster in cocurrent flow relationship to each other.

In the dedusting process and system of FIG. 14, dust-laden heavy shale oil is fed generally horizontally through oil line 200 into the left-hand side of an upstream mixer 202. Dedusting solvents and dedusted oil from the downstream deduster 204 are fed through recycle line 206 into the left-hand side of the upstream mixer so as to be injected into the upstream mixer in cocurrent flow relationship to the influent dusty oil. In the upstream mixer, the dusty oil from oil line 200 is dissolved and mixed with the solvents and dedusted oil from recycle line 206 by a motor-driven mechanical agitator, propeller, or blades 208. The dissolved oil and solvents are fed to an upstream deduster 210 through dissolved oil feed line 212. The dedusted stream of oil and solvents is withdrawn from the upper portion of the upstream deduster through overhead dedusted stream line 214. The residual stream of solvents and oil settles to the bottom of the upstream deduster and it is discharged through outlet line 216 and fed into a downstream mixer 218.

Fresh makeup polar and non-polar dedusting solvents are fed into the left-hand side of the downstream mixer 218 (FIG. 14) through solvent feed line 220 in cocurrent flow relationship to the stream 216 of oil and solvents. In the downstream mixer, the residual stream of oil and solvents is mixed with fresh makeup solvents by a motor-driven mechanical agitator, propeller, or blades 222. The mixed residual stream and makeup solvents are fed generally horizontally into the left-hand side of the downstream deduster 204 through downstream feed line 224. Solvents and dedusted oil are withdrawn from the upper portion of the downstream deduster and recycled to the upstream mixer 202 through recycle line 206. The residual stream of dust-laden sludge settles to the bottom of the downstream deduster and is removed from the downstream deduster through sludge line 226. The other aspects of the process and system of FIG. 14 are similar to FIG. 1.

In the solvent recovery system of FIG. 15, the dedusted stream of oil and dedusting solvents is fed through dedusted stream line 230 into the middle portion of a distillation column 232. The distillation column can be operated from negative pressure (vacuum) to 50 psig at an operating temperature from 100° F. to 500° F. and preferably from 150° F. to 300° F. for best results. The dedusted stream of oil and solvents is separated in the distillation column into a substantially purified stream of polar and non-polar dedusting solvents and a substantially solvent free stream of shale oil containing from 0.05% to 3%, and preferably less than 0.1%, by weight solvents. The separated stream of dedusting solvents is withdrawn from the upper portion of the distillation column through an overhead solvent recovery line 234. The solvent-free oil is withdrawn from the bottom portion of the distillation column through oil recovery line 236.

Figure 16:
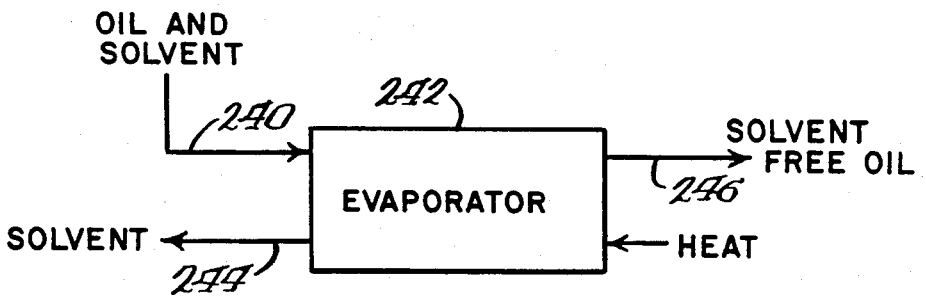
FIG. 16 is a schematic flow diagram of a multiple-effect evaporator for recovering solvents from the dedusted stream.

In the solvent recovery system of FIG. 16, the dedusted stream of oil and dedusting solvents is fed through dedusted stream line 240 into a multiple-effect evaporator 242, such as a triple-effect evaporator. The evaporator is operated at a pressure from 1 to 2 atmospheres at an operating temperature from 100° F. to 500° F. and preferably from 150° F. to 300° F. for best results. The liquid residence time in the evaporator is from 3 seconds to 3 hours and preferably a few minutes. The multiple-effect evaporator is particularly useful because it is energy-efficient. The dedusted stream of oil and solvents is evaporated and separated in the evaporator into a purified stream of polar and non-polar dedusting solvents and a substantially solvent-free stream of oil containing from 0.1% to 10%, preferably less than 1%, by weight solvents. The recovered solvent stream is withdrawn from the evaporator through overhead solvent recovery line 244. The solvent-free oil stream is withdrawn from the evaporator through oil recovery line 246.

Figure 17:
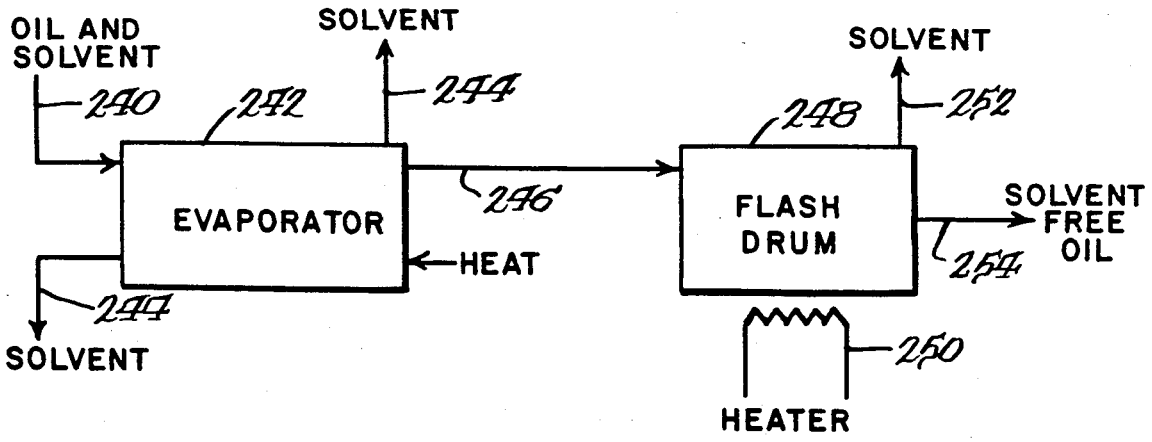
FIG. 17 is a schematic flow diagram of a multiple-effect evaporator and flash drum for recovering solvents from the dedusted stream.

The solvent recovery system and process of FIG. 17 is similar to the solvent recovery system and process of FIG. 16, except that the effluent stream of substantially solvent-free oil is fed to a flash drum 248 as a polishing step to evaporate and recover the residual dedusting solvents in the oil stream. The flash drum is heated to a temperature ranging from 150° F. to 700° F. and preferably about 300° F. to 500° F. at an operating pressure from negative pressure (vacuum) to 2 atmospheres by heater 250 to flash off and recover the residual dedusting solvents in the oil stream. The solvents are withdrawn from the flash drum through overhead solvent recovery line 252. The flashed, substantially solvent-free oil which contains 0.1% to 1% and preferably less than 0.1% by weight solvent is withdrawn from the flash drum through oil recovery line 254.

Much more heat duty is required to evaporate polar solvents than to evaporate non-polar solvents. The solvent recovery process and system of FIG. 18 overcomes this problem by recovering most of the polar solvents through a phase separation with heavy oil.

Figure 18:
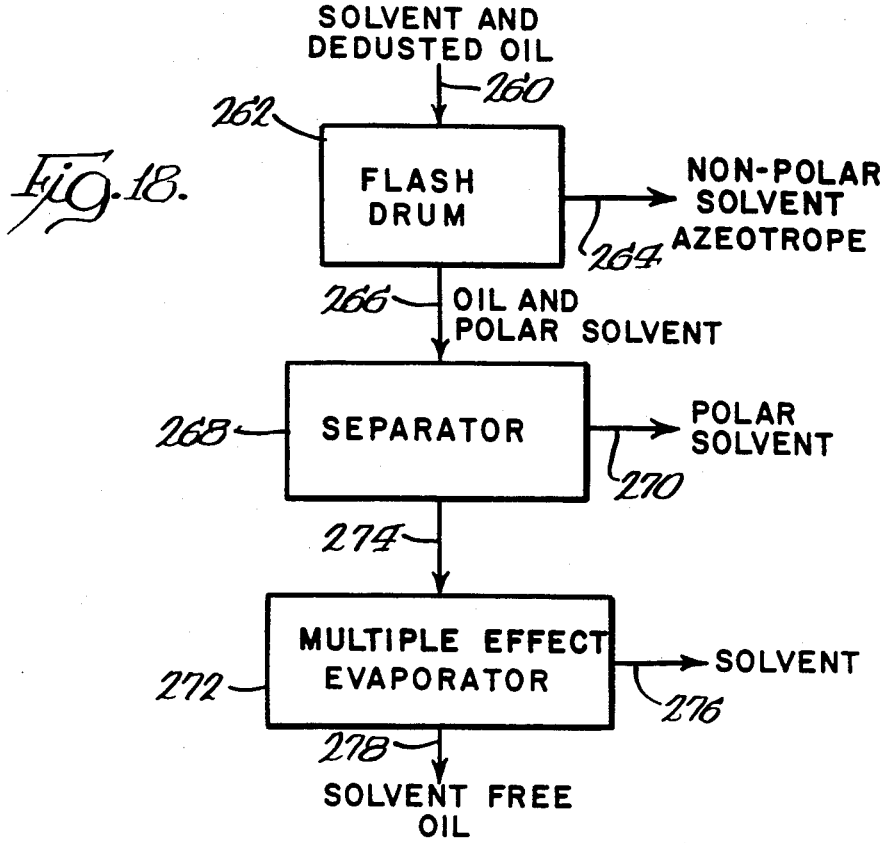
FIG. 18 is a schematic flow diagram of a flash drum, settler, and multiple-effect evaporator for recovering solvents from the dedusted stream.

In the solvent recovery process and system of FIG. 18, the dedusted stream of oil and dedusting solvents is fed through a dedusted stream line 260 into a flash drum 262 where it is heated to a temperature ranging from 100° F. to 300° F. at an operating pressure from negative pressure (vacuum) to 2 atmospheres to flash off, evaporate, and substantially separate all the non-polar solvents from the dedusted stream. The separated azeotrope stream of non-polar solvents, which contains from 5% to 55%, and preferably less than 30%, by weight polar solvents, is withdrawn from the flash drum through non-polar solvent recovery line 264. The flashed, dedusted stream of oil and polar solvents, which has an oil-to-polar solvent ratio ranging from 1:2 to 2:1, is discharged from the flash drum through discharge line 266 and fed to the upper portion of a separator 268, such as a settler. The settler is operated at a temperature ranging from 0° F. to 120° F. and preferably below 100° F. at atmospheric pressure.

In the settler 268 (FIG. 18), the oil and the dedusting polar solvents are separated into a polar solvent stream containing from 1% to 10%, and preferably less than 5%, by weight entrained shale oil, and an oil stream containing from 10% to 40%, and preferably less than 20%, by weight polar solvents. The polar solvent stream is removed from the settler through polar solvent recovery line 270. The oil stream settles to the bottom of the settler and is fed to the upper portion of a multiple-effect evaporator 272, preferably a triple-effect evaporator, through oil line 274. The multiple-effect evaporator is operated under conditions similar to the evaporator of FIG. 16. The multiple-effect evaporator evaporates, separates, and recovers the residual solvents in the oil stream. The recovered dedusting solvents are withdrawn from the evaporator through solvent recovery line 276. The substantially solvent-free oil is withdrawn from the evaporator through oil recovery line 278.

Figure 19:
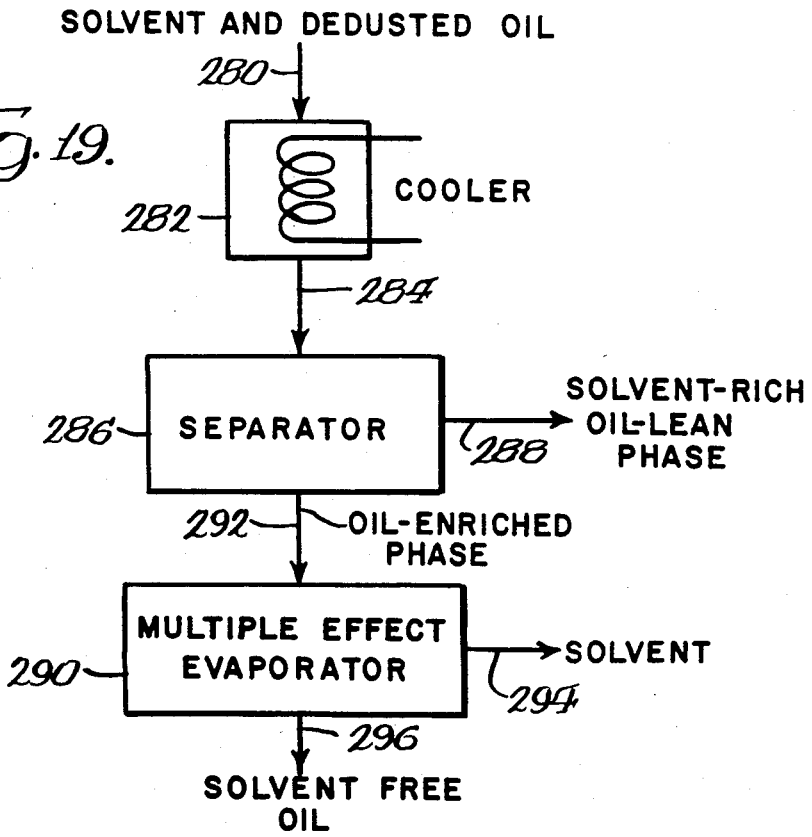
FIG. 19 is a schematic flow diagram of a cooler, settler, and multiple-effect evaporator for recovering solvents from the dedusted stream.

The heat duty required to recover the dedusting solvents from the dedusted stream of oil and solvents is reduced from two to tenfold by cooling the dedusted stream before decanting and evaporating (separating) the stream as best shown in FIG. 19. In the solvent recovery process and system of FIG. 19, the dedusted stream of oil and dedusting solvents in dedusted stream line 280, which exits the deduster at a temperature from 160° F. to 250° F. and at a pressure from 20 psig to 150 psig, is fed to a cooler or heat exchanger 282, where the dedusted stream is cooled to a temperature ranging from 32° F. to 120° F., and preferably less than 90° F., for best results. The cooled, dedusted stream is withdrawn from the cooler (heat exchanger) and fed through a cooled dedusted stream line 284 into the upper portion of a separator 286, such as a mixer settler. The cooled, dedusted stream is separated in the settler into a solvent stream and an oil stream. The solvent stream, which contains mostly dedusting solvents and 0.1% to 10%, and preferably less than 5%, by weight shale oil, is withdrawn from the settler through solvent recovery line 288. The oil stream, which contains mostly shale oil and from 10% to 50%, and preferably less than 20%, by weight solvents, settles in the bottom of the separator and is fed to the upper portion of a multiple-effect evaporator 290, such as a triple-effect evaporator, through oil feed line 292. The multiple-effect evaporator is operated at conditions similar to the evaporator of FIG. 16. In the evaporator 290, the influent oil stream is separated into a solvent stream and a substantially solvent-free oil stream. The solvent stream is withdrawn from the evaporator through recycle solvent line 294. The solvent-free oil stream is withdrawn from the evaporator through solvent free oil line 296.

In the solvent recovery processes and systems of FIGS. 15–19, all the recovered polar and non-polar dedusting solvents are preferably fed (recycled) to the deduster for use in dissolving and dedusting the influent dusty shale oil. The recovered solvent-free dedusted shale oil is transported downstream to upgrading equipment, such as a hydrotreater or a catalytic cracker.

The dedusting solvents used in this invention to dissolve and dedust the dusty shale oil in the deduster are a blend, mixture, and/or combination of polar and non-polar dedusting solvents as described previously. The use of both polar and non-polar dedusting solvents for dedusting is vastly superior to the use of either (only) polar solvents or non-polar solvents alone. The indicated polar and non-polar dedusting solvents together have a much faster settling rate than the use of non-polar solvents alone. The indicated polar and non-polar dedusting solvents together recover, dissolve, and dedust a much greater percentage by weight of the heavy dust-laden shale oil than do polar solvents alone. Substantially less residual oil settles with the sludge with the indicated mixture of polar and non-polar dedusting solvents than with polar solvents alone. The indicated polar and non-polar dedusting solvents also separate and settle a greater percentage of the oil shale dust in the sludge than do either polar or non-polar solvents alone. Data supporting these advantages are clearly shown in the following examples:

EXAMPLES 1–3

Dust-laden heavy shale oil was fed at a temperature of 120° F. at atmospheric pressure into a deduster. Dedusting solvents were fed at a temperature of 120° F. at atmospheric pressure into the deduster. The deduster was operated at atmospheric pressure at a temperature of about 120° F. The heavy shale oil had a mean boiling point of 815° F. by weight, an API gravity of 13°, and contained 47% by weight entrained particulates of oil shale dust. The dusty heavy oil and dedusting solvents were mixed together by a mechanical agitator (mixer) for about 1 minute to dissolve the dusty oil in the dedusting solvents before settling the shale dust from the oil. The settling rates, feed ratio, type of solvents, and percentage of oil dedusted, as well as other pertinent information, are shown in the following table (chart). The dedusted oil contained less than 1,000 ppm oil shale dust on a solvent-free basis. In Example 1, only a polar solvent was used as the dedusting solvent. In Example 2, only a non-polar solvent was used as the dedusting solvent. In Example 3, a blend of polar and non-polar solvents was used as the dedusting solvent. Unless otherwise stated, all references to percentages are by weight.

EXAMPLES 1–3

| | Example 1 Polar Solvent Alone | Example 2 Non-Polar Solvent Alone | Example 3 Mixture of Polar and Non-Polar Solvents |
|---|---|---|---|
| Polar Solvent | Methanol | — | Methanol |
| % Polar Solvent | 100 | 0 | 55 |
| Non-Polar Solvent | — | Hexane | Hexane |
| % Non-Polar Solvent | 0 | 100 | 45 |
| Feed Ratio of Solvent(s) to Dusty Shale Oil | 3:1 | 3:1 | 3:1 |

-continued

| EXAMPLES 1-3 | | | |
|---|---|---|---|
| | Example 1 Polar Solvent Alone | Example 2 Non-Polar Solvent Alone | Example 3 Mixture of Polar and Non-Polar Solvents |
| Settling Rate (ft/hr) | 100 | 3 | 110 |
| % Oil Recovery, Dissolved and Dedusted | 42 | 88 | 96 |
| % Residual Oil in Sludge | 33 | 12 | 6 |
| % Dust in Sludge | 48 | 39 | 55 |

It can be seen from Examples 1-3 that the dedusting solvent containing 55% by weight methanol and 45% by weight hexane produces a much faster settling rate than hexane (non-polar solvent) alone. The dedusting solvent containing 55% by weight methanol and 45% by weight hexane also: recovers, dissolves, and dedusts a greater percentage of oil than polar (methanol) or non-polar (hexane) solvents alone; loses less residual oil in the sludge than either polar (methanol) or non-polar (hexane) solvents alone; and settles a greater percentage of the oil shale dust in the sludge than either polar (methanol) or non-polar (hexane) solvents alone.

EXAMPLES 4-6

Dust-laden heavy shale oil was dedusted in the same apparatus under similar conditions as described in Examples 1-3, except as noted below. The heavy shale oil had a mean boiling point of 875° F. by weight, an API gravity of 11.5°, and contained 62% by weight particulates of oil shale dust. The dust-laden heavy shale oil and the solvents were fed to the dedusters at 120° F. In Example 4, only a polar solvent was used as the dedusting solvent. In Example 5, only a non-polar solvent was used as the dedusting solvent. In Example 6, a blend of polar and non-polar solvents was used as the dedusting solvent. The dedusted oil contained less than 1,000 ppm of oil shale dust on a solvent-free basis.

| EXAMPLES 4-6 | | | |
|---|---|---|---|
| | Example 4 Polar Solvent Alone | Example 5 Non-Polar Solvent Alone | Example 6 Mixture of Polar and Non-Polar Solvents |
| Polar Solvent | Methanol | — | Methanol |
| % Polar Solvent | 100 | 0 | 65 |
| Non-Polar Solvent | — | Hexane | Hexane |
| % Non-Polar Solvent | 0 | 100 | 35 |
| Feed Ratio of Solvent(s) to Dusty Shale Oil | 3:1 | 3:1 | 3:1 |
| Settling Rate (ft/hr) | 100+ | 2 | 61 |
| % Oil Recovery, Dissolved and Dedusted | 27 | 82 | 76 |
| % Residual Oil in Sludge | 22 | 6 | 10 |
| % Dust in Sludge | 48 | 36 | 59 |

It can be seen from Examples 4-6 that a dedusting solvent containing 65% by weight methanol and 35% by weight hexane: had a much faster settling rate than the hexane (non-polar solvent) alone; recovered, dissolved, and dedusted a much greater percentage of oil than the polar solvent (methanol) alone; resulted in less loss of residual oil settling in the sludge than the use of a polar solvent (methanol) alone; and resulted in settling a greater percentage of the oil shale dust in the sludge than either the polar (methanol) or non-polar (hexane) solvents alone.

EXAMPLES 7-9

Dust-laden heavy shale oil was dedusted in the same apparatus under similar conditions as described in Examples 1-3, except as noted below. The dust-laden shale oil and dedusting solvents were fed to the dedusters at a temperature of 85° F. The heavy oil shale oil had a mean boiling point of 815° F. by weight, an API gravity of 13°, and contained 47% by weight particulates of oil shale dust. The feed ratio of dedusting solvents to dust-laden heavy shale oil was 3:1 rather than 2:1 as in Examples 1-6. In Example 7, only a polar solvent was used as the dedusting solvent. In Example 8, only a non-polar solvent was used as the dedusting solvent. In Example 9, a blend of polar and non-polar solvents was used as the dedusting solvent. The dedusted oil contained less than 1,000 ppm of oil shale dust on a solvent-free basis.

| EXAMPLES 7-9 | | | |
|---|---|---|---|
| | Example 7 Polar Solvent Alone | Example 8 Non-Polar Solvent Alone | Example 9 Mixture of Polar and Non-Polar Solvents |
| Polar Solvent | Methanol | — | Methanol |
| % Polar Solvent | 100 | 0 | 57 |
| Non-Polar Solvent | — | Pentane | Pentane |
| % Non-Polar Solvent | 0 | 100 | 43 |
| Feed Ratio of Solvent(s) to Dusty Shale Oil | 2:1 | 2:1 | 2:1 |
| Settling Rate (ft/hr) | 106 | 13 | 103 |
| % Oil Recovery, Dissolved and Dedusted | 26 | 80 | 87 |
| % Residual Oil in Sludge | 44 | 17 | 10 |
| % Dust in Sludge | 51 | 53 | 62 |

It can be seen from Examples 7-9 that a dedusting solvent containing 57% by weight methanol and 43% by weight pentane produced a much greater settling rate than the non-polar solvent (pentane) alone; recovered, dissolved, and dedusted a greater percentage of the dusty heavy shale oil than either the polar solvent (methanol) or the non-polar solvent (pentane) alone; resulted in less loss of oil settling in the sludge than either the polar solvent (methanol) or the non-polar solvent (pentane) alone; and settled a greater percentage of oil shale dust in the sludge than either the polar solvent (methanol) or the non-polar solvent (pentane) alone.

It has been found that a small portion of the shale oil is insoluble in the dedusting mixture of polar and non-polar solvents and acts as a flocculant to agglomerate, precipitate, and stick the fines (oil shale dust) together. The flocculated fines settle to the bottom of the deduster and are removed for solvent recovery and fuel for the combustor as described previously. For heavy shale oil having a mean boiling point of 815° F. by weight and an API gravity of 13°, the correlation of the percentage of heavy shale oil recovered and dedusted for a given dedusting temperature for a dedusting solvent containing both methanol (a polar solvent) and hexane (a non-polar solvent) for a two-stage countercurrent dedusting system is dependent on the proportion of dusty shale oil, methanol, and hexane fed into the deduster according to the following formula:

$$R = 197\,H + 119\,M - 160S$$

where R is the percentage of shale oil recovered and dedusted; H is the percentage (weight fraction) of hexane fed to the deduster; M is the percentage (weight fraction) of methanol fed to the deduster; and S is the percentage (weight fraction) of dusty heavy shale oil fed to the deduster. The weight ratio of methanol to hexane is preferably maintained above 55:45 for rapid settling. The weight fraction of heavy shale oil is also preferably maintained above 15% to 20% to assure generally rapid settling.

The relative proportions of shale oil, polar solvents, and non-polar solvents attained in the dedusted phase and the dusty residual (sludge) phase in the deduster, and in the solvent phase and the solvent-free oil phase in the settler of the solvent recovery system, 16 are dependent on the temperature of the deduster and the temperature of the cooler or heat exchanger. This is illustrated in Example 10.

EXAMPLE 10

Dust-laden heavy shale oil containing 45% by weight particulates of oil shale dust was fed to a deduster. A dedusting solvent containing both methanol (a polar solvent) and hexane (a non-polar solvent) was fed to the deduster. The oil and solvent feed temperature was 70° C. The operating temperature of the deduster was 70° C. at a pressure of 20 psig. The proportions of oil, methanol, and hexane fed into the deduster are indicated at point 300 on the phase diagram of FIG. 13: 20% by weight heavy shale oil, 60% by weight methanol, and 20% by weight hexane. When the oil became dissolved and mixed with the dedusting solvents, the mixture separated into two phases: a dedusted phase 302 and a dust-enriched residual phase 304 of sludge. The dedusted phase 302 contained about 20% by weight heavy shale oil, 60% by weight methanol, and 20% by weight hexane. The dust-enriched phase 304 of sludge contained about 38% by weight heavy shale oil, 47% by weight methanol, and 15% by weight hexane (excluding the weight of the dust). The dedusted phase 302 (decanted phase) was cooled to 20° C. in a cooler. The cooled, dedusted phase separated into two phases: a solvent phase 306 and a shale oil phase 308. The solvent phase 306 contained about 71% by weight methanol, 23% by weight hexane, and 6% by weight shale oil. The oil phase 308 contained about 68% by weight oil, 8% by weight hexane, and 24% by weight methanol. After further processing, the solvent phase was recycled to the deduster for use as part of the dedusting solvent.

Generally rapid settling was obtained by coalescing the solid particulates of oil shale dust, which was a result of mixing the dusty shale oil in both the polar and non-polar solvents. Coalescence occurred when the insoluble portion of the shale oil coated the shale dust particles. The coalesced soild settled at rates on the order of 100 feet per hour, while individual particles of dust settled at rates of only a few inches per hour.

The solvent dedusting process and system of this invention is particularly advantageous because it features high oil recovery and low dust carryover into the recovered oil. In the solvent dedusting process, from 80% to 99%, and preferably at least 95%, by weight of the dusty shale oil is effectively dedusted to contain less than 1%, preferably less than 0.3%, and most preferably less than 0.1%, by weight oil shale dust.

Although embodiments of this invention have been shown and described, it is to be understood that various modifications and substitutions, as well as rearrangements of parts, components, equipment, and/or process steps, can be made by those skilled in the art without departing from the novel spirit and scope of this invention.

What is claimed is:

1. A system for producing and dedusting shale oil, comprising:

a retort for liberating an effluent product stream of hydrocarbons from raw oil shale;

raw oil shale feed means for feeding raw oil shale to said retort;

heat carrier feed means for feeding both spent oil shale and combusted dried sludge to said retort to heat said raw oil shale to a retorting temperature;

combustion means for combusting retorted oil shale and dried sludge;

gas-solids removal means comprising at least one member selected from the group consisting of a cyclone and a filter, for partially dedusting said effluent product stream;

at least one separator selected from the group consisting essentially of a fractionator, a scrubber, and a quench tower, for separating a fraction of heavy shale oil containing particulates of oil shale dust from said effluent product stream;

cooling means for cooling said heavy shale oil;

solvent deduster means comprising at least one member selected from the group consisting of a pressure-driven static mixer, a settler, a vessel with internals, an extraction column, and a mechanical mixer, for mixing and dissolving said heavy shale oil in solvents and for separating said dissolved heavy shale oil into a dedusted stream of heavy shale oil and solvents and a dust-enriched stream of sludge;

extract solvent recovery means operatively connected to and positioned downstream of said solvent deduster means for separating said dedusted stream into a solvent stream and a generally solvent-free oil stream;

sludge solvent recovery means comprising a dryer operatively connected to and positioned downstream of said solvent deduster means for evaporating and removing solvents from said sludge and for drying said sludge; and solvent feed means for feeding solvents to said solvent deduster means, said solvent feed means including a first recycle solvent line for feeding said removed solvents from said dryer to said solvent deduster means, a second recycle solvent line for feeding said solvent stream from said extract solvent recovery means to said solvent deduster means, a polar solvent feed line for feeding fresh makeup polar solvent to said solvent deduster means, and a non-polar solvent feed line for feeding fresh makeup non-polar solvent to said solvent deduster means.

2. A system in accordance with claim 1 wherein said dryer comprises a disc dryer.

3. A system in accordance with claim 1 wherein said solvent feed means includes a unitary fresh solvent line connected to and positioned downstream of said polar and non-polar feed lines and upstream of said deduster means for receiving, combining, blending, and feeding fresh makeup polar and non-polar dedusting solvents from said polar and non-polar feed lines into said solvent deduster means.

4. A system in accordance with claim 1 wherein said solvent feed means includes a unitary recycled solvent line connected to said first and second recycle solvent lines for receiving, combining, and simultaneously feeding recovered solvent from said first and second solvent lines into said solvent dedusting means.

5. A system in accordance with claim 1 wherein said solvent feed means includes a common unitary, single recycle feed line connected to said recycle solvent lines and said polar and non-polar solvent feed lines for feeding fresh makeup polar and non-polar dedusting solvents and said recovered solvents simultaneously into said solvent deduster means.

6. A system in accordance with claim 1 wherein said extract solvent recovery means includes an evaporator and a flash drum operatively connected to and positioned downstream of said evaporator.

7. A system in accordance with claim 1 wherein said extract solvent recovery means comprises a flash drum operatively connected to and positioned downstream of said solvent deduster means, a separator comprising a settler operatively connected to and positioned downstream of said flash drum, and a multiple-effect evaporator operatively connected to and positioned downstream of said settler.

8. A system in accordance with claim 1 wherein said extract solvent recovery means includes a cooler, a separator comprising a settler operatively connected to and positioned downstream of said cooler, and a multiple-effect evaporator operatively connected to and positioned downstream of said settler.

* * * * *

UNITED STATES PATENT AND TRADEMARK OFFICE

CERTIFICATE OF CORRECTION

PATENT NO. : 4,670,104

DATED : June 2, 1987

INVENTOR(S) : James L. Taylor

It is certified that error appears in the above-identified patent and that said Letters Patent is hereby corrected as shown below:

| Column | Line | |
|---|---|---|
| 1 | 38 | "produce duce shale" should be -- produce shale -- |
| 21 | 20 | "system, 16 are" should be -- system, are -- |

Signed and Sealed this

Fifteenth Day of June, 1993

*Attest:*

Michael K. Kirk

MICHAEL K. KIRK

*Attesting Officer*

*Acting Commissioner of Patents and Trademarks*